US008601723B2

(12) United States Patent
Kreutzer et al.

(10) Patent No.: US 8,601,723 B2
(45) Date of Patent: Dec. 10, 2013

(54) COLLAPSIBLE SNOWSHOE

(75) Inventors: Debra J. Kreutzer, Henniker, NH (US); James S. Page, Florence, MA (US); Matt E. Page, Florence, MA (US)

(73) Assignee: Debra J. Kreutzer, Henniker, NH (US)

( * ) Notice: Subject to any disclaimer, the term of this patent is extended or adjusted under 35 U.S.C. 154(b) by 115 days.

(21) Appl. No.: 13/218,192

(22) Filed: Aug. 25, 2011

(65) Prior Publication Data

US 2011/0308112 A1 Dec. 22, 2011

Related U.S. Application Data

(63) Continuation of application No. 11/982,880, filed on Nov. 5, 2007, now Pat. No. 8,006,412.

(60) Provisional application No. 60/857,696, filed on Nov. 7, 2006.

(51) Int. Cl.
*A43B 5/04* (2006.01)

(52) U.S. Cl.
USPC ..... 36/123

(58) Field of Classification Search
USPC ..... 36/123, 122, 124
See application file for complete search history.

(56) References Cited

U.S. PATENT DOCUMENTS 3,599,352 A * 8/1971 Novak et al. ..... 36/123
3,619,915 A * 11/1971 Cheney ..... 36/122
4,203,236 A * 5/1980 Erickson et al. ..... 36/123
4,328,627 A 5/1982 Sanders
4,334,369 A 6/1982 Brunel etal.
4,348,823 A * 9/1982 Knapp et al. ..... 36/123
4,720,927 A 1/1988 Abegg
5,228,705 A 7/1993 Merle-Smith
5,253,437 A 10/1993 Klebahn et al.
5,277,141 A 1/1994 Csepregi
5,440,827 A 8/1995 Klebahn et al.
5,459,950 A * 10/1995 Damm et al. ..... 36/122
5,615,901 A 4/1997 Piotrowski
5,662,338 A 9/1997 Steinhauser, Jr.
5,699,630 A 12/1997 Klebahn et al.
5,740,621 A 4/1998 Wing et al.
5,791,662 A 8/1998 Searby et al.
5,810,368 A 9/1998 Steinhauser, Jr.
5,839,734 A 11/1998 Steinhauser, Jr.

(Continued)

FOREIGN PATENT DOCUMENTS

WO WO-2012/109463 A1 8/2012

OTHER PUBLICATIONS

International Search Report for Application No. PCT/US07/23304 dated of mailing Jul. 18, 2008.

*Primary Examiner* — Ted Kavanaugh
(74) *Attorney, Agent, or Firm* — Mintz Levin Cohn Ferris Glovsky and Popeo, P.C.

(57) ABSTRACT

A collapsible snowshoe is provided. The snowshoe includes a frame having a first supporting cross-bar configured to interact with a second supporting cross-bar, wherein the cross-bars are configured to alternate between an open position and a closed position, a first supporting material configured to be coupled to the cross-bars and further configured to extend between the cross-bars, whereby the extended supporting material creates a support surface for walking when the cross-bars are in the open position; and a frame-locking mechanism configured to secure the cross-bars in the open position.

20 Claims, 19 Drawing Sheets

(56) References Cited

U.S. PATENT DOCUMENTS

| | | | | |
|---|---|---|---|---|
| 5,845,927 | A | 12/1998 | Steinhauser, Jr. | |
| 5,899,006 | A | 5/1999 | Donnadieu | |
| 5,966,844 | A | 10/1999 | Hellerman et al. | |
| 5,992,861 | A | 11/1999 | Piotrowski | |
| 6,026,597 | A | 2/2000 | Burnet et al. | |
| 6,065,758 | A | 5/2000 | Steinhauser, Jr. | |
| 6,092,828 | A | 7/2000 | Schumacher | |
| 6,105,281 | A * | 8/2000 | Wing et al. | 36/122 |
| 6,113,111 | A | 9/2000 | Gierveld et al. | |
| 6,195,919 | B1 | 3/2001 | Forrest et al. | |
| 6,216,366 | B1 | 4/2001 | Donnadieu | |
| 6,217,035 | B1 | 4/2001 | Steinhauser, Jr. | |
| 6,382,638 | B1 | 5/2002 | Lee | |
| 6,564,478 | B1 * | 5/2003 | Wing et al. | 36/122 |
| 6,669,211 | B2 | 12/2003 | Gonthier | |
| 6,684,534 | B2 | 2/2004 | Dodge | |
| 6,711,835 | B1 | 3/2004 | Militello | |
| 6,763,617 | B1 | 7/2004 | Stafford | |
| 6,938,362 | B2 | 9/2005 | Saillet et al. | |
| 8,006,412 | B2 * | 8/2011 | Kreutzer et al. | 36/123 |
| 2002/0017771 | A1 | 2/2002 | McManus et al. | |
| 2004/0056449 | A1 | 3/2004 | Girard et al. | |
| 2004/0150213 | A1 | 8/2004 | Dodge | |

* cited by examiner

Present Invention

COLLAPSIBLE SNOWSHOE

CROSS-REFERENCE TO RELATED APPLICATIONS

The present application claims priority to and is a continuation application of U.S. patent application Ser. No. 11/982,880 to Kreutzer et al., filed Nov. 5, 2007 entitled "Collapsible Snowshoe", which claims priority to U.S. Provisional patent application Ser. No. 60/857,696 to Kreutzer, filed Nov. 7, 2006 and entitled "Convertible Winter Sports Footwear" and incorporates their entire disclosures herein by reference.

The present application relates to U.S. Provisional Patent Application Ser. No. 60/761,994 to Kreutzer, filed Jan. 24, 2006 and entitled "Multi-Purpose Sports Shoe", and incorporates its entire disclosure herein by reference.

BACKGROUND OF THE INVENTION

1. Field of the Invention

The present invention relates to footwear. Specifically, the present invention relates to winter sports equipment. It relates to items worn on feet, shoes that convert for use on different surfaces, or items that attach to shoes and convert them for use on different surfaces such as pavement, snow, ice, and/or other surfaces.

2. Background of the Invention

Over the years, the footwear technologies evolved to a greater level in providing individuals with various types of footwear. Typically, footwear is designed with a particular purpose in mind. Besides the basic types of footwear, e.g., shoes, boots, sandals, and slippers, there are special type of footwear such as hiking boots, running sneakers, rollerblades, ice-skating boots, snowshoes, ski boots and other types of specialty footwear.

Walking on snow covered surfaces is entirely different than walking on hard surfaces. This is because snow, especially powder snow, has lesser density than other hard surfaces, such as, soil, asphalt, stones, etc. Because of this, walkers typically would struggle walking on snow in regular footwear and oftentimes would fall through the snow. As such, snowshoes are typically used for walking on snow surfaces. Conventional snowshoes (illustrated in FIG. 2*b*) include larger sole surface to provide greater support and floatation on the snow to their user. To secure the snowshoes on user's feet, the snowshoes include bulky bindings that provide support and coupling of the snowshoe to the user's feet during walking. Snowshoe bindings typically secure the front of the user's feet to the sole of the snowshoe. User's heels (or the back of the foot) are typically secured by a binding strap or any other means. The heels are typically are not permanently/tightly secured to the snowshoe's sole. This allows relative motion of the heel with respect to sole of the snowshoe, when the user is walking. The front of the snowshoe is typically curved/tilted in an upward direction, which aids in making steps and general walking capability. When walking in snowshoes, the user typically puts one foot forward thereby putting pressure on that foot, while the other foot remains behind the first foot and the majority of the sole of the snowshoe of the other foot is lifted off of the walking surface (the front of that snowshoe's sole is what typically remains on the surface).

Further, in order to provide adequate support and maneuverability to the user on the snow, a snowshoe should have proper flotation, articulation, control, and traction (hereinafter, "FACT"). Flotation provides the user of the snowshoes with adequate support on the surface of the shoe. Proper articulation of the snowshoe allows the user flexibility during walking on snow, i.e., lifting snowshoes off of the ground and allowing elevation of the user's heels. Control allows the user to make precise movements of the snowshoes during walking. Traction prevents sliding and tripping. Some conventional snowshoes have attempted to combine all four characteristics but at the cost of sacrificing one quality for the other, i.e., the snowshoes can have good traction, but fail to provide adequate articulation. Other conventional snowshoes attempt to provide its user with good floatation but poor control on the snow.

Further, conventional snowshoes fail to provide users with requisite versatility. As such, many such snowshoes lack compactness, convenience, and low-cost. As illustrated in FIG. 2*b*, conventional snowshoes are bulky, heavy, and cumbersome in operation when walking on snow. Additionally, conventional snowshoes typically are incapable of being collapsed. As such, conventional snowshoes require large amount of storage space. Because of their large size, it is difficult to carry such snowshoes (e.g., it is difficult to fit such snowshoes into a backpack).

Thus, there is a need for a snowshoe that is collapsible, versatile, light-weight, compact and provides its user with adequate floatation, articulation, control, and traction.

SUMMARY OF THE INVENTION

The present invention relates to an article of footwear. In some embodiments, the present invention relates to a collapsible snowshoe including a frame having a first supporting cross-bar configured to interact with a second supporting cross-bar, wherein the cross-bars are configured to alternate between an open position and a closed position; a first supporting material configured to be coupled to the cross-bars and further configured to extend between the cross-bars, whereby the extended supporting material creates a support surface for walking when the cross-bars are in the open position; and a frame-locking mechanism configured to secure the cross-bars in the open position.

In some embodiments, the present invention relates to a system for walking using a collapsible snowshoe. The system includes a plurality of cross-bars configured to interact with each other, wherein the cross-bars are further configured to switch between an open position and a closed position, whereby in the open position, outermost tips of the cross-bars are configured to move away from one another, and in the closed position, the outermost tips of the cross-bars are configured to move toward each other; an extendable supporting material secured to at least portions of the cross-bars and configured to provide largest support area when the cross-bars are in the open position; and a locking mechanism configured to secure the cross-bars in the open position.

In other embodiments, the present invention relates to a method for walking using a snowshoe, having a supporting cross-bar pivotally coupled to another supporting cross-bar, wherein the cross-bars are configured to alternate between an open position and a closed position, a supporting material configured to be coupled to the cross-bars and further configured to extend between the cross-bars, whereby the extended supporting material creates a surface for walking when the cross-bars are in the open position, and a frame-locking mechanism configured to secure the cross-bars in the open position. The method includes rotating cross-bars from the closed position to the open position; and securing the supporting material to the front portion of the cross-bars using the frame-locking mechanism.

In yet other embodiments, the present invention relates to a method of manufacturing a snowshoe, having a first cross-bar configured to interact with a second cross-bar, wherein the cross-bars are configured to alternate between an open position and a closed position, a first supporting material configured to be coupled to the cross-bars and further configured to extend between the cross-bars, whereby the extended first supporting material creates a surface for walking when the cross-bars are in the open position, a second supporting material configured to restrain rotation of the cross-bars, and a frame-locking mechanism configured to secure the cross-bars in the open position. The method includes steps of providing cross-bars; securing the cross-bars to each other; coupling at least a portion of the first supporting material to the back portion of each of the cross-bars; coupling at least a portion of the second supporting material to the front portion of each of the cross-bars, wherein the second supporting material is configured to extend between the front portion of the cross-bars when the cross-bars are in the open position; and securing frame-locking mechanism to at least another portion of the first supporting material.

In yet other embodiments, the present invention relates to a collapsible snowshoe including a frame having a plate configured to secure a plurality of structural members; a supporting material configured to be secured to the structural members; wherein the members are configured to expand into an open position thereby providing a support surface area for the user, and collapse into a closed position, wherein in the closed position the structural members are configured to be secured underneath the plate; and, a locking mechanism configured to secure the members in the open position.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

The present invention relates to an article of footwear. Specifically, the present invention relates to a collapsible snowshoe.

Some of the advantages of the present invention are its smaller size and lightweight constructions. As opposed to conventional snowshoes (FIG. 2*b*), the present invention's snowshoes are less cumbersome and can be slid into a sack and strapped to backpacks or carried with greater ease than conventional snowshoes. Further, the present invention's snowshoes are easily deployed (extended) and/or retracted (collapsed) for convenience. Small (collapsed) size of the snowshoes is easy to transport (multiple pairs) in cars, on public transport, or anywhere else. Also, the present invention's snowshoes can be easily stored in closet corners, shelves, and/or fit into standard size luggage for travel. Additionally, in retail, very little shelf space needs to be devoted to them, therefore allowing a greater number of units to be displayed, stacked, and/or stored. This is very advantageous for schools, health clubs, resorts or other public organizations that may wish to procure many units, but have limited storage space.

Further, the present invention's snowshoes can be used in military, alpine (e.g., hikers and rescue personnel), or other types of applications where limited carrying capacity exists and the equipment is desirable to have available. In cases where there is an uncertain need for snowshoes, the decision to take them "just in case" is simplified by the ease of carrying and use. May be considered safety gear.

Unlike conventional snowshoes, the present invention's snowshoes do not require straps, buckles, snaps and/or other adjustments that make the conventional snowshoe bulky and cumbersome. Further, the manufacturing cost of the present invention's snowshoes is substantially less than that of the conventional snowshoes.

Additionally, conventional snowshoes must be left outside upon entering most buildings (including homes, restaurants, shops, ski lodges, schools, public buildings, other), thereby making them vulnerable to theft. The collapsible snowshoe, like an umbrella, can be collapsed upon arrival, conveniently carried with the owner/user, and easily re-deployed upon leaving the building.

Some of the embodiments of the present invention may include a shoe suitable for walking on any surface, such as a dry ground surface. The shoe may also incorporate one or more features that convert the shoe for use on snow, ice, and/or other types of surfaces. The following is a description of various exemplary embodiments of a shoe according to the present invention.

Figure 1A:
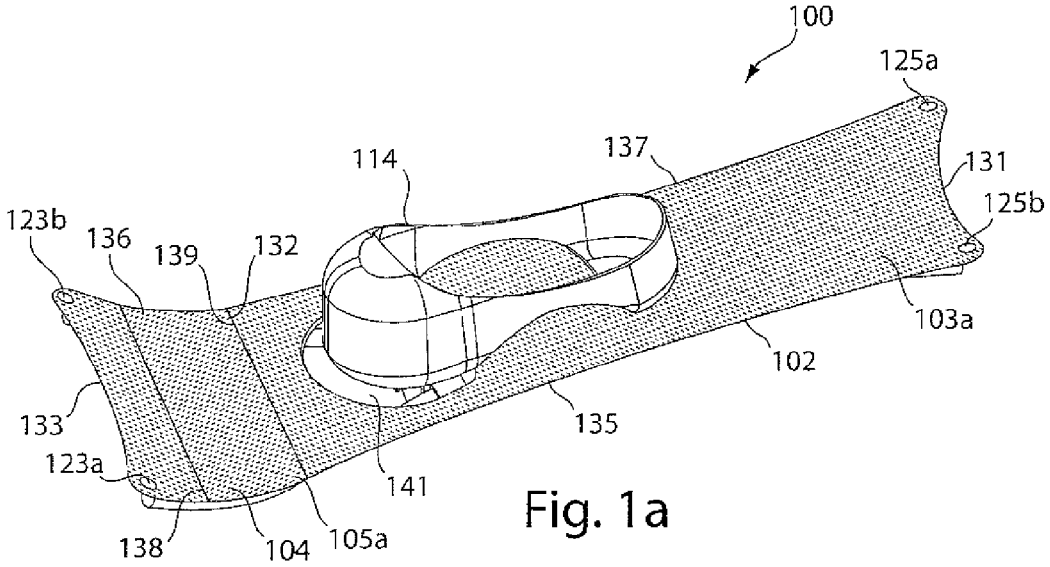
FIGS. 1*a*-1*g* illustrate an exemplary embodiment of a collapsible snowshoe, according to some embodiments of the present invention.
Figure 1B:
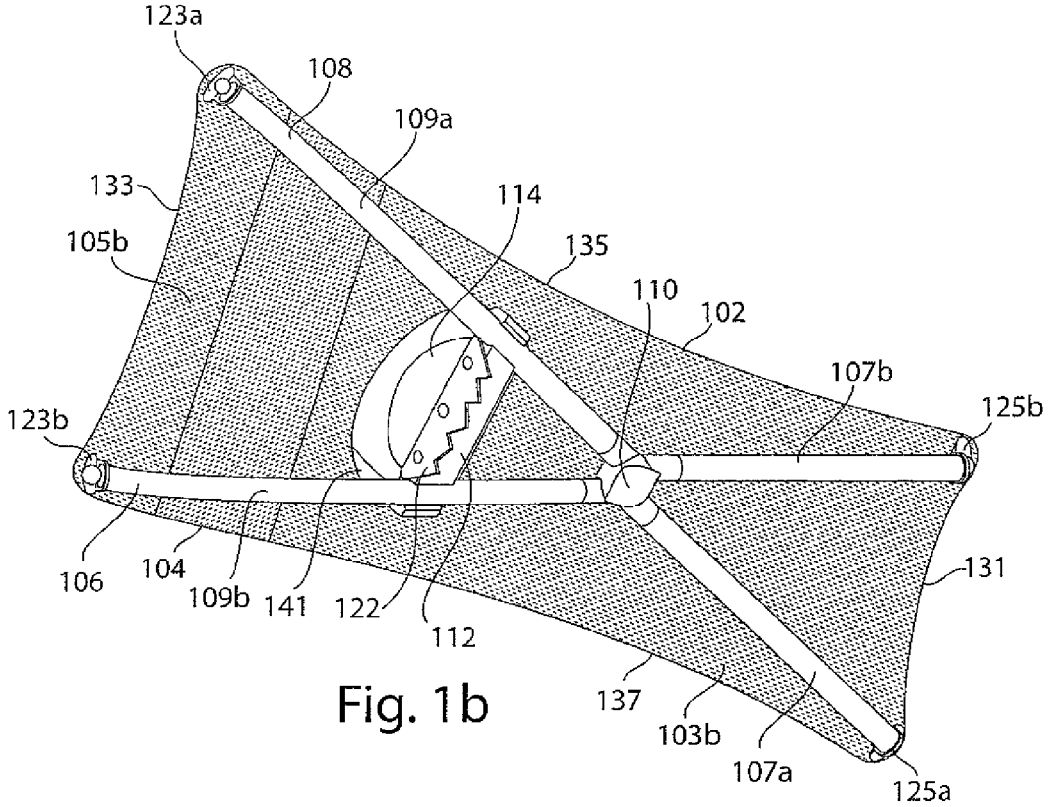
Figure 1C:
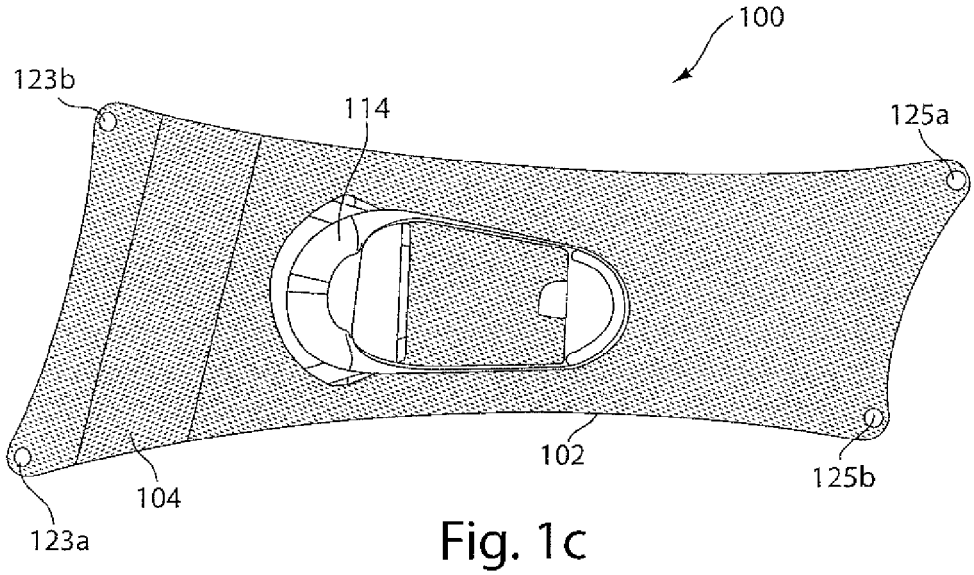
Figure 1D:
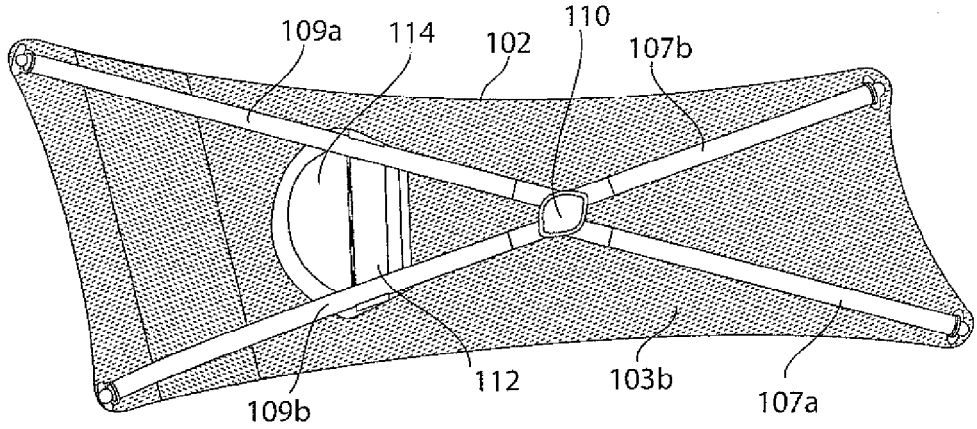
Figure 1E:
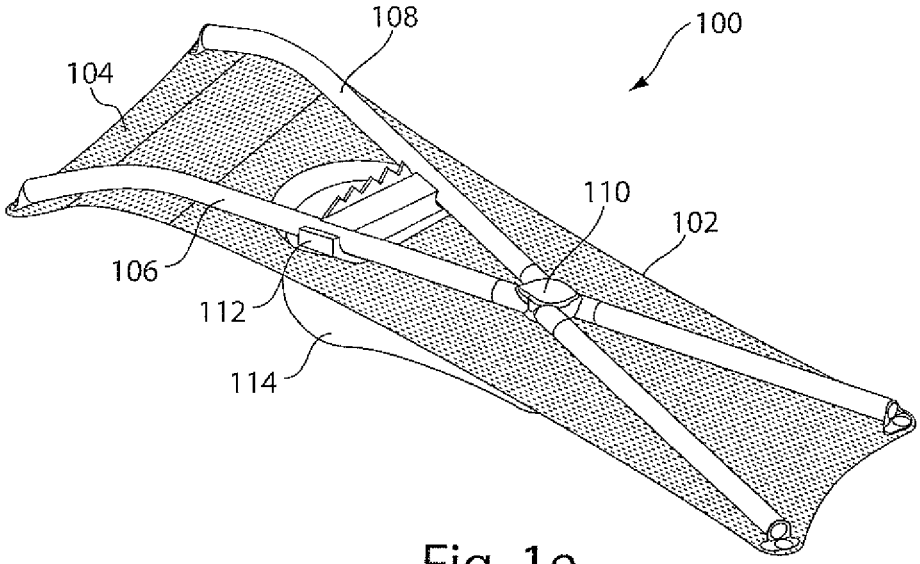
Figure 1F:
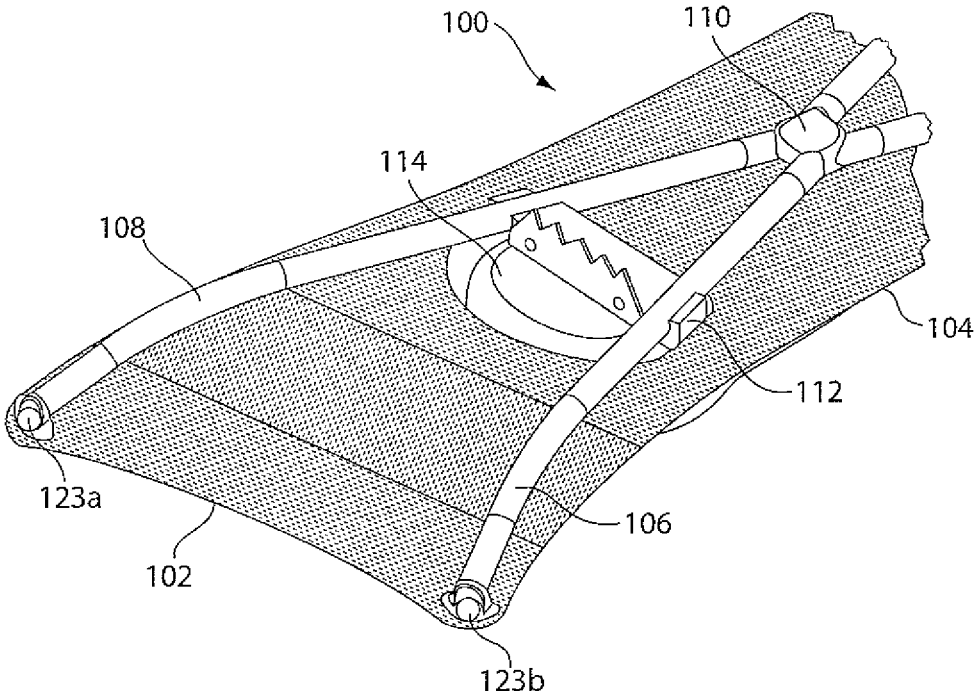
Figure 1G:
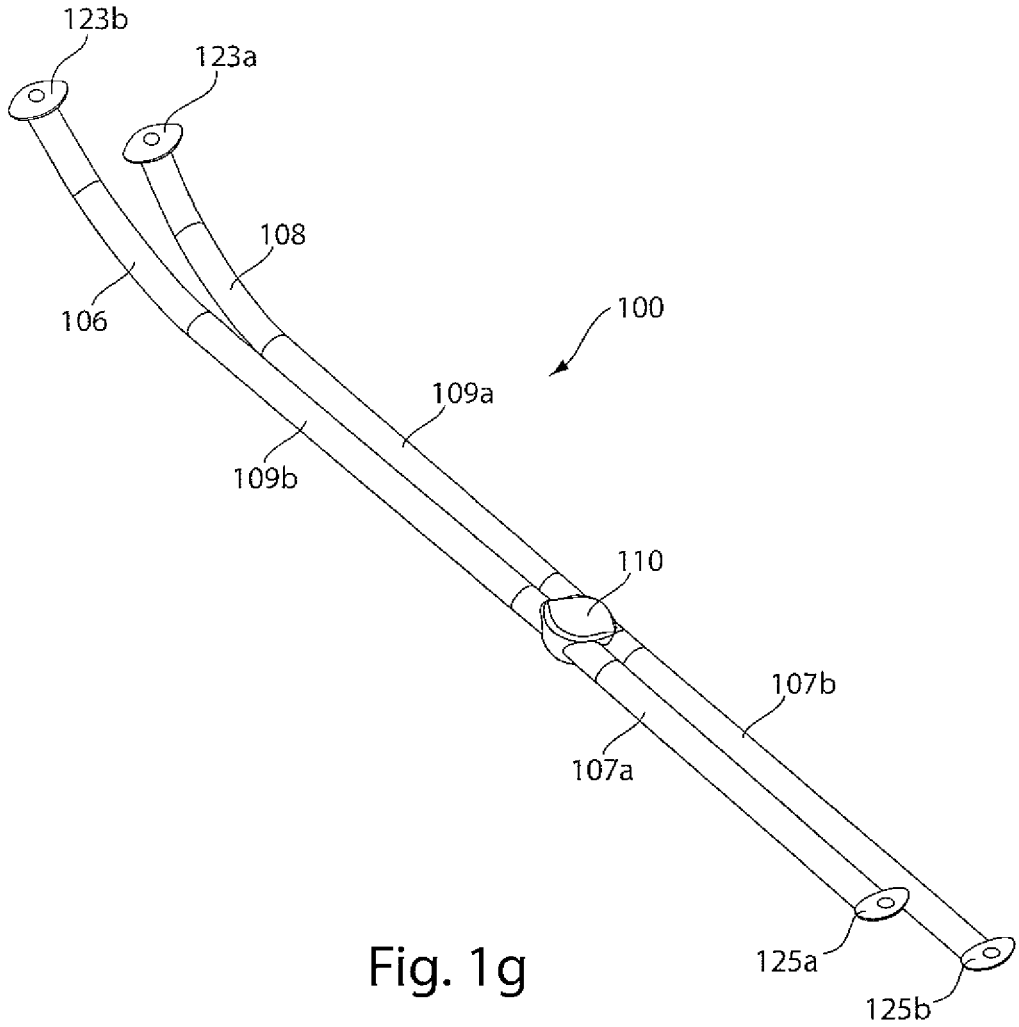

FIGS. 1*a*-1*g* illustrate various views of an exemplary collapsible snowshoe 100, according to some embodiments of the present invention. Specifically, FIG. 1*a* is a top perspective view of the snowshoe 100. FIG. 1*b* is a bottom perspective view of the snowshoe 100. FIG. 1*c* is a top view of the snowshoe 100. FIG. 1*d* is a bottom view of the snowshoe 100. FIG. 1*e* is a bottom perspective view of the snowshoe 100. FIG. 1*f* is a bottom view of a portion of the snowshoe 100. FIG. 1*g* is a perspective view of the cross-bars of the snowshoe 100.

In some embodiments, the collapsible snowshoe 100 includes a primary supporting material or scaffolding material 102, a secondary supporting material 104, a first cross-bar 106, a second cross-bar 108, a connector 110, and a frame-locking mechanism 112. The frame-locking mechanism can also include an ice-carving blade 122. In some embodiments, the snowshoe 100 can also include a shoe-holder 114.

The shoe holder 114 can be configured to accommodate insertion of any type shoe. Such shoe-holders 114 can be a rubber slide-on (there are many brands that are nearly identical, for example, "Get-a-Grip" brand is one of the available ones from Base Gear, LLC (www.basegear.com)).

The cross-bars 106 and 108 can be configured to constitute a frame of the snowshoe 100. As illustrated in FIGS. 1*a*-1*f*, the cross-bars 106 and 108 are configured to interconnect using a connector 110. In some embodiments, the connector 110 can be a pivotal connector that allows pivotal motion of the cross-bars and allows the cross-bars to be folded together, as illustrated in FIG. 1*g*.

The shoe-supporting material 102 further includes a top portion 103*a* and a bottom portion 103*b*. The cross-bars 106 and 108 are configured to be adjacent to the bottom portion 103*b* and opposite of the top portion 103*a* of the material 102. The supporting material 104 also includes a top portion 105*a* and a bottom portion 105*b*. Similar to the material 102, the bottom portion 105*b* is configured to be adjacent to the cross-bars 106 and 108 and the top potion 105*a* is configured to be opposite of the cross-bars 106 and 108.

The shoe-supporting material 102 further includes a front part 132, a back part 131, and sides 135 and 137. The sides 135 and 137 are disposed between the front part 132 and the back part 131. The back part 131 is further configured to be disposed between tips 125*a* and 125*b* of the cross-bars 106 and 108. The ends of the back part 131 are configured to be permanently coupled to the tips 125 (*a, b*). Such coupling can be using welding, soldering, gluing, stapling, sewing, or by way of any other means or methods. In some embodiments, the back part is further configured to form a catenary curve (also can be called the "alysoid," "funicular," and/or "chainette") between the tips 125. This means that the back part includes a varying degree of concavity as compared to a straight line connecting the tips 125. In some embodiments, the radius of the catenary curve formed by the back part 131 can be in the range of 5 to 500 inches. In other embodiments, the radius of this catenary curve can be 10 inches. As can be understood by one skilled in the art, the catenary curve formed by the back part 131 can have any other radius in the range, below the lowest number in the above range, or above the highest number in the above range.

The shoe-supporting material 104 also includes a front part 133, a back part 139, and sides 136 and 138. The sides 136 and 138 are configured to be disposed between the front part 133 and the back part 139. The front part 133 is further configured to be disposed between tips 123*a* and 123*b* of the cross-bars 106 and 108. The ends of the front part 133 are also configured to be permanently coupled to the tips 123 (*a, b*). Such coupling can be also done using welding, soldering, gluing, stapling, sewing, or by way of any other means or methods. In some embodiments, the front part is further configured to form a catenary curve between the tips 123. This means that the front part 133 includes a varying degree of concavity as compared to a straight line connecting the tips 123. In some embodiments, the radius of the catenary curve formed by the front part 133 can be in the range of 7 to 500 inches. Alternatively, the range can be 100 to 400 inches. In other embodiments, the radius of this catenary curve can be 25 inches. As can be understood by one skilled in the art, the catenary curve formed by the front part 133 can have any other radius in the range, below the lowest number in the above range, or above the highest number in the above range.

The back part 139 of the supporting material 104 and the front part 132 of the supporting material 102 are configured to be adjacent to each other, as illustrated in FIG. 1*a*. This allows the supporting materials 102 and 104 to form a substantially uniform surface that is configured to support a user when snowshoeing on the snow. In some embodiments, such uniform surface can have a total surface area in the range of 75 square inches to 375 square inches. Depending on the weight (or otherwise any characteristic) of the user, the surface area can be in the range of 75 to 225 square inches for a smaller user. Alternatively, the surface area can be in the range of 125-300 square inches for a medium size user. Yet alternatively, the surface area can be in the range of 175-375 square inches for a larger user. In some embodiments, the total surface area can be 150 square inches for a smaller user, 190 square inches for a medium size user, and 275 square inches for a larger user. As can be understood by one skilled in the art, the above ranges and sizes can be adjusted based on particular characteristics of the user (e.g., weight, height, foot size, etc.). Additionally, the above sizes can be also adjusted based on the surface conditions for which the user intends to use the snowshoe.

Further, the sides 136 and 137 of the supporting materials 104 and 102, respectively, are configured to form a substantially uniform side. Similarly, sides 138 and 135 are also configured to form a substantially uniform side. As illustrated in FIG. 1*b*, these uniform sides are configured to extend away from the cross-bars 106 and 108 and provide a large or otherwise sufficient support surface area to the user walking in the snowshoes. Further, the distances from the respective cross-bars to the sides 135, 136, 137, and 138 are configured to increase toward the connector 110 (as illustrated in FIG. 1*b*). Similar to the front and back parts 133 and 131, respectively, of these supporting materials, such uniform sides are also characterized by catenary curves. In some embodiments, these catenary curves can be configured to have a radius in the range between 30 inches to 500 inches. Alternatively, the radius of the catenary curves can be 65 inches.

In some embodiments, the support materials 102 and 104 are configured to include an opening 141. The opening 141 allows for insertion of the frame-locking mechanism 112. The frame-locking mechanism 112 is configured to secure the cross-bars 106 and 108 in an open position, as illustrated in FIG. 1*b*. In the open position, the cross-bars 106 and 108 are configured to be spread apart and thus, the tips 123*a* and 123*b*, as well as, tips 125*a* and 125*b* are configured to extend away from each other to a maximum possible distance. The open position of the cross-bars 106 and 108 is also configured to allow the user to use the snowshoes 100 for walking. A closed position of the cross-bars 106 and 108 is illustrated in FIG. 1*g*. In the closed position, the cross-bars 106 and 108 are configured to be substantially adjacent to each other. In the closed position, the snowshoes 100 can be stored in a case, bag, closed, etc. Such closed position allows for compact storage of the snowshoes 100. In the open position (as illustrated in FIG. 1*b*), the cross-bars 106 and 108 form an angle between each other. In the closed position, the cross-bars 106 and 108 are configured to be substantially parallel to each other, as illustrated in FIG. 1*g*.

As illustrated in FIG. 1*g*, the cross-bars 106 and 108 can be configured as two tubes interconnected by the connector 110. In some embodiments, the cross-bars 106 and 108 can be four tubes connected by the connector 110. The tubes 106 and 108 can be configured to rotate or pivot about the connector 110, thereby making connector 110 a pivotal connector. In the embodiments having four separate tubes, each tube can be configured to separate rotate or pivot around the pivotal connector 110. In some embodiments, each cross-bar 106 and 108 can be configured to have a flattened section that is further configured to match the other cross-bar's flattened section, where the flattened section overlay and are secured to each other (by way of a bolt, screw, nail, etc.), thereby forming the pivotal connector 110. As can be understood by one skilled in the art, the pivotal connector can be formed in any other way, including, ball-and-socket connection, roller connection, or any other suitable connection that allows rotation, oscillation, pivoting motion, or any other circular motion.

Figure 7:
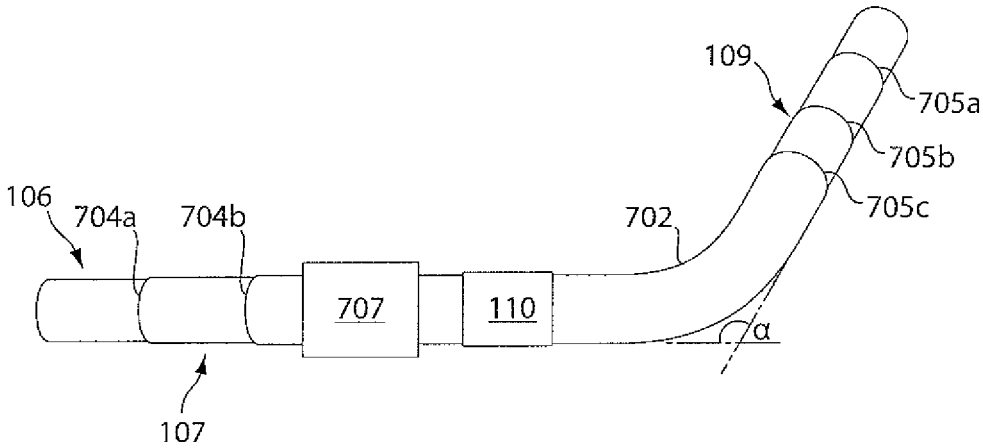
FIG. 7 illustrates a cross-bar of an exemplary collapsible snowshoe, according to some embodiments of the present invention.

Referring to FIG. 7, illustrating the cross-bar 106 (or 108), and FIG. 1*b*, the cross-bars can be configured to include front portions 109(*a, b*) and back portions 107(*a, b*). In some embodiments, the front and back portions are separated by the connector 110. In other embodiments, the portions 109*a*, 109*b*, 107*a*, and 107*b* can be separate portions configured to perform angular or circular motions around the connector 110. The front portions 109 are configured to secure the shoe-supporting material 104. The frame-locking mechanism 112 also secures to the front portions 109, as illustrated in FIG. 1*b*. The cross-bars' front portions also include a rounded portion 702, which allows partial curving of the front portions 109. The front portions are configured to curve in an upward direction and away from the plane of the walking surface. In some embodiments, the front portions are configured to curve at an angle $\alpha$, which can be in the range of 10° to 90°. Alternatively, the range can be 20° to 70°. In some embodiments, $\alpha$=34°. The curvature of the front portions allows the user to walk normally as the user would walk in normal shoes (i.e., putting one foot forward, bending the other foot at the toes of the foot, and then carrying over the other foot forward, while bending the first foot, and so on). As can be understood by one skilled in the art, $\alpha$ can vary from one snowshoe's cross-bars to another snowshoe's cross-bars (i.e., the pair of snowshoes need not have an identical angle $\alpha$), as well as, $\alpha$ can vary from one cross-bar's front portion to the other cross-bar's front portion on the same snowshoe.

In some embodiments, the cross-bars can be collapsible, as illustrated in FIG. 7. The front portion is configured to include nested sections 705(*a, b, c*). The nested sections are configured to fit one within the other in the collapsed stated and further configured to expand and lock to each other in the expanded state of the cross-bar. Further, in order to be collapsible, the sections 705 can be telescopically arranged, that is, section 705*a* can have a smaller diameter than section 705*b*, which can have a smaller diameter than section 705*c*. Reverse arrangement as well as any other arrangement of diameters of the sections 705 is also possible. As can be understood by one skilled in the art, there can be any number of sections 705. Further, other ways of collapsing the snowshoe's front portion are possible, such as folding sections 705, one onto the other. Further, the back portion's sections 704(*a, b, c*) are also configured to be collapsible similar to the front portion's sections 704(*a, b, c*). Thus, the above description of sections 705 is applicable to the sections 704.

As further illustrated in FIG. 7, the back portion 107 further includes optional additional support sections 707. The support sections 707 can be configured to be permanently (or removably) attached to the back portions 707 and provide further support to the user during overloading conditions. An overloading condition can be defined as a situation when excessive pressure is placed by the user on the snowshoe's surface. In some embodiments, the support sections 707 can be rigid rubber (or any other suitable material) tubing configured to join together parts of the back portion 107. As such during normal (non-overload) conditions, the tubing 707 is configured to behave similar to an inflexible cross-bar. However, during overload conditions, the tubing 707 is configured to flex allowing the user the extra support, control, and as well as, improving snowshoe's FACT characteristics.

As stated above, the front and back portions of the cross-bars can be substantially round tubes. In some embodiments, the tubes can be hollow in order to reduce weight of the snowshoe. The tubes can be manufactured from aluminum, stainless steel, titanium, plastic, wood, carbon fiber, magnesium, magnesium-lithium alloy, steel, fiber, or any other suitable material. The diameter of the tubes can be in the range of 8 millimeters ("mm") to 40 mm. Alternatively, the diameter range can be 15 nm to 25 mm. Alternatively, the diameter of the tubes can be 19 mm. As can be understood by one skilled in the art, the diameter of the tubes can vary from one tube to the other (i.e., from one cross-bar to the other), as well as, it can vary from portion of the cross-bar to the other portion of the cross-bar. Further, within each specific portion of the cross-bar, the diameter of the tube can vary as desired. In some embodiments, the tubes can have a uniform diameter throughout. Further, in the telescopic cross-bars embodiment, discussed in connection with FIG. 7 above, the diameter of each section 704 (and/or 705) can vary from one another. Additionally, the cross-bars can have a round, oval, square, rectangular, polygonal, irregular, or any other desired cross-section.

Figure 8:
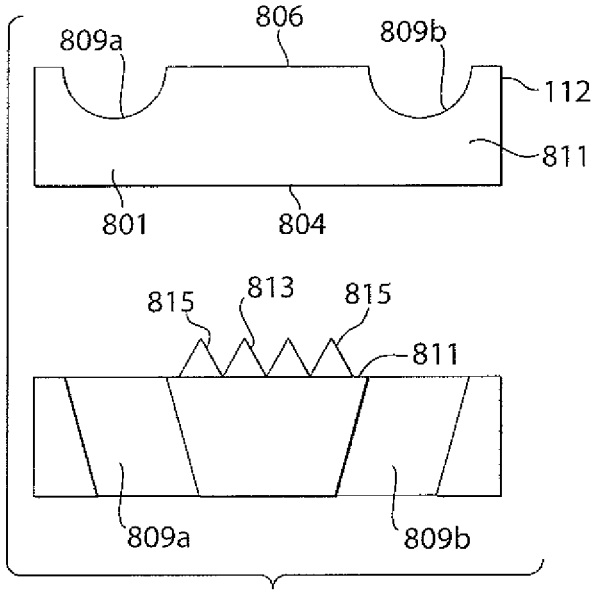
FIG. 8 illustrates a traction mechanism of an exemplary collapsible snowshoe, according to some embodiments of the present invention.

Referring back to FIGS. 1*a*-1*g*, the frame-locking mechanism 112 is configured to secure the cross-bars 106 and 108 in the open position. Referring to FIG. 8, illustrating the side view (at the top) and the top view (at the bottom) of the frame-locking mechanism 112, the mechanism 112 includes a body 801 having a top portion 804, a bottom 806, a side 811, an icing blade 813, and grooves 809 (*a, b*). The grooves 809 are disposed diagonally within the body 801 and are configured to match the size of the cross-bars 106 and 108. The diagonal disposition of the grooves 809 can be determined by the angle that the cross-bars form in the open position. The grooves are further configured to snap onto the cross-bars 106 and 108 and secure the cross-bars in the open position. As can be understood by one skilled in the art, the grooves 809 can secure the cross-bars in the open position in any other manner, such as friction-fit, lock the bars using screws, bolts, nails, VELCRO™, or any other way. In some embodiments, the frame-locking mechanism 809 includes the traction element or an ice blade 813 that is configured to provide further traction to the snowshoe 100 (the traction element 813 is also illustrated in FIGS. 1*a*-*g*) and/or to improve FACT characteristics of the snowshoe 100. The traction element 813 can include a plurality of extensions 815 that may be sharp so as to allow better interaction of the shoe 100 with the walking surface.

Figure 5:
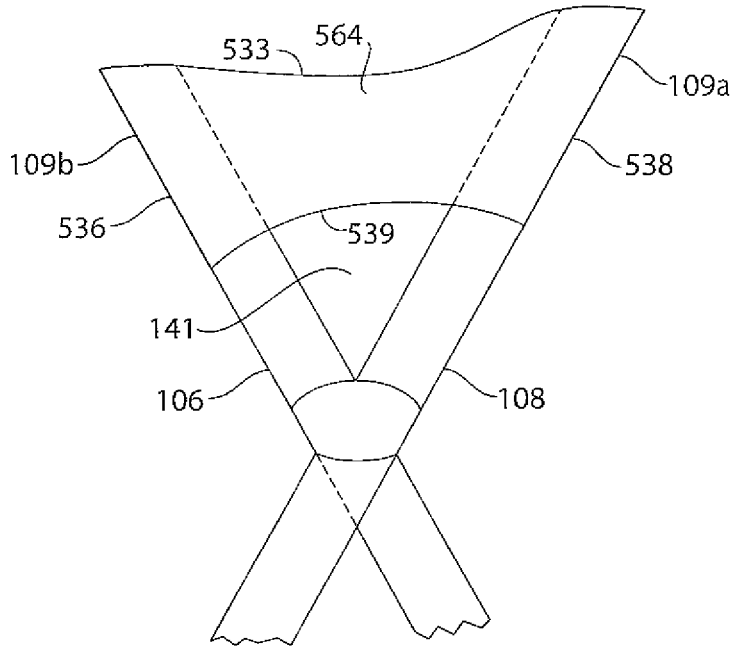
FIG. 5 illustrates a front portion of an exemplary collapsible snowshoe, according to some embodiments of the present invention.
Figure 6:
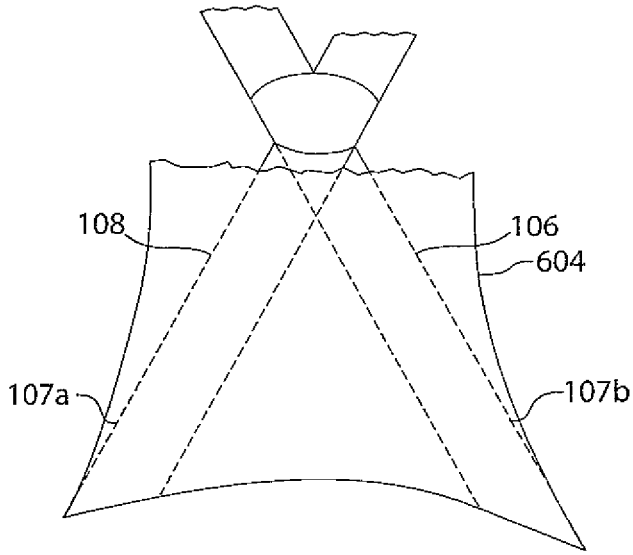
FIG. 6 illustrates a back portion of an exemplary collapsible snowshoe, according to some embodiments of the present invention.

FIG. 5 illustrates an alternate embodiment of the front portions 109 of the cross-bars 106 and 108 along with the secondary shoe-supporting or scaffolding material 504. The material 504 is configured to have a front portion 533, a back portion 539, and sides 536, 538. As illustrated in FIG. 5, the front and back portions 533, 539 are configured to have catenary curves. The radius for those curves can be in the ranges indicated above for FIGS. 1*a*-1*g*. The catenary curve of the back portions 539 allows a large opening 141, which provides the user with flexibility in location on the cross-bars, when attaching frame-locking mechanism to the cross-bars. FIG. 6 illustrates a rear portion 107 of each of the cross-bars 106 and 108. As shown in FIG. 6, the supporting material 602 (similar to material 102) also includes a catenary curve discussed above.

Figure 2A:
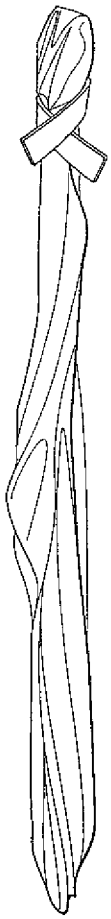
FIG. 2*a* illustrates an exemplary embodiment of a collapsible snowshoe in a collapsed state, according to some embodiment of the present invention.
Figure 2B:
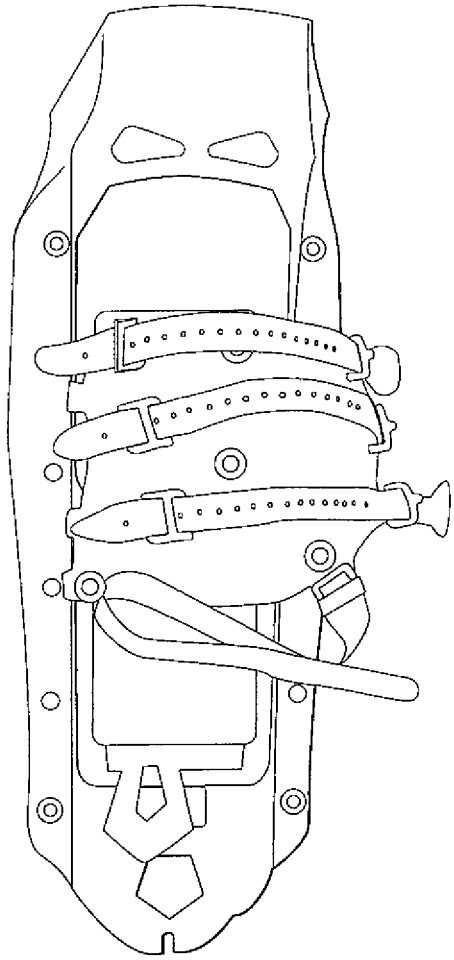
Prior Art Fig. 2b
FIG. 2*b* illustrates a conventional snowshoe.
Figure 3:
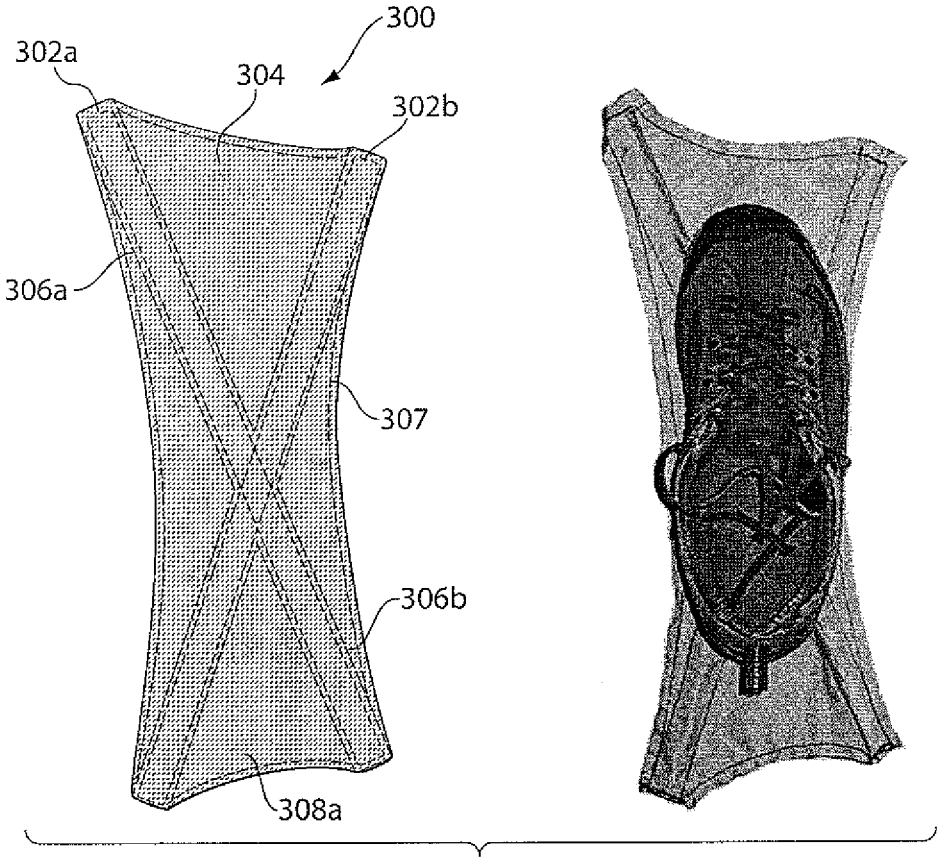
FIG. 3 illustrates another exemplary embodiment of a collapsible snowshoe, according to some embodiments of the present invention.
Figure 4:
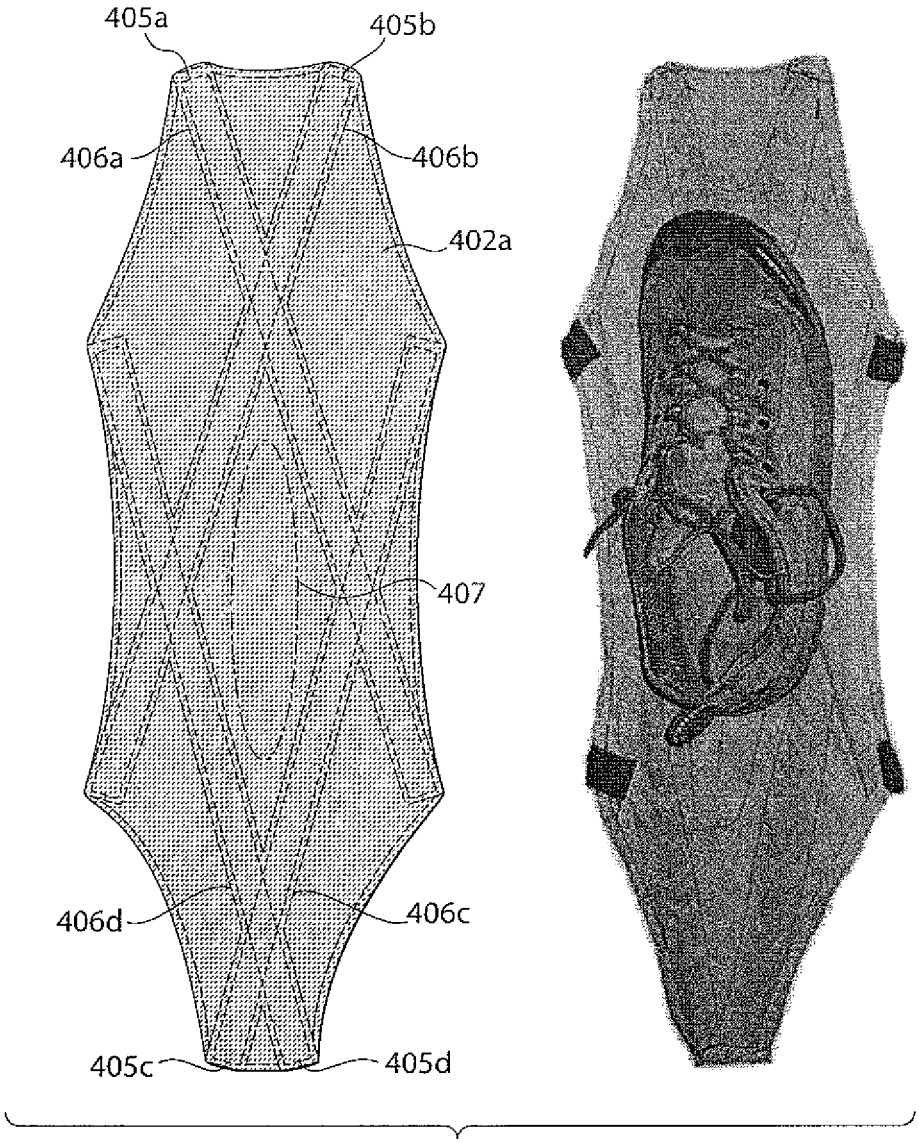
FIG. 4 illustrates yet another exemplary embodiment of a collapsible snowshoe, according to some embodiments of the present invention.

FIGS. 2*a*, 3 and 4 illustrate alternate embodiments of the snowshoe, according to the present invention. FIG. 2*a* (section entitled "Present Invention") illustrates a collapsed arrangement of the snowshoe. The collapsed arrangement is compared to the conventional snowshoe design (on the right side of FIG. 2*a*, entitled "Prior Art"). Clearly, the collapsed snowshoe is much smaller, and can be easily stored either in the user's backpack, bag, closed, or any other place without taking up a lot of space. Additionally, because of the present invention's snowshoe's lightweight construction, the snowshoe can be easily carried around and can be quickly put on user's feet for snowshoeing.

FIG. 3 illustrates an exemplary snowshoe 300, according to some embodiments of the present invention. Snowshoe 300 includes two cross-bars 302(*a, b*) that are configured to cross each other inside the shoe-supporting or scaffolding material 304. The supporting material 304 can be configured to include channels 306(*a, b*) that are further configured to accommodate placement of the cross-bars 302(*a, b*), respectively. In some embodiments, the cross-bars 302 can be sewed inside the material 304 within channels 306. Further, the material 304 can include a top sheet 308*a* and a bottom sheet 308*b* (not shown in FIG. 3). The sheets 308 can be stitched together using stitching 307. Stitching 307 also stitches together channels 306 that have cross-bars 302 placed inside them. A shoe-holder (not shown in FIG. 3, but is illustrated in FIGS. 1*a*-1*g*) can be configured to be secured to the material's top sheet 308*a*. A traction element or an ice blade (not shown in FIG. 3, but illustrated in FIGS. 1*a*-1*g*) can be secured to the bottom sheet 308*b* in a similar fashion as illustrated in FIGS. 1*a*-1*g*. Further, the embodiment in FIG. 3 can also include a frame-locking mechanism that is similar to the frame-locking mechanism 112 (illustrated in FIGS. 1*a*-1*g*). The frame locking mechanism can also be secured to the cross-bars 302 in a similar fashion as the frame locking mechanism 112.

FIG. 4 illustrates an exemplary snowshoe 400, according to some embodiments of the present invention. The snowshoe 400 includes plurality cross-bars 405. As illustrated in FIG. 4, the snowshoe 400 includes four cross-bars 405. The snowshoe 400 includes shoe-supporting or scaffolding material that is composed of a top sheet 402*a* and a bottom sheet 402*b* that are configured to be stitched together via stitching 403. In some embodiments, stitching 403 can be located along the edges of the sheets 402. The sheets 402 are stitched so as to form a plurality of channels 406(*a, b, c, d*). Channels 406 are configured to accommodate placement of cross-bars 405, respectively. As illustrated in FIG. 4, channel 406*a* is configured to cross with channel 406*b* and channel 406*c*; channel 406*b* is configured to cross with channel 406*d*; and channel 406*c* is configured to cross with channel 406*d*. Such crossing of channels 406 further allows crossing of cross-bars 405 at the points where channels 406 intersect. In the embodiments of FIGS. 3 and 4, the cross-bars 302 and 405 are not connected to each other by way of connectors and, as such, are secured to the shoe-supporting material by way of respective channels 306 and 406. Such arrangement allows the user further flexibility when using the snowshoe. Similar to FIG. 3, the supporting material is composed of a top sheet 402*a* and a bottom sheet 402*b*. The support material can also include an opening 407 for placement of frame locking mechanism (similar to mechanism 112 of FIGS. 1*a*-1*g*), attachment of a shoe holder (similar to the shoe holder 114 of FIGS. 1*a*-1*g*), and an optional traction mechanism/ice blade. FIGS. 3 and 4 also illustrate (on the right side of the figures) how a user's shoe can be secured to the respective supporting materials.

When snowshoes 300 and 400 are not in use, they can be folded/collapsed into a thin enclosure, as illustrated in FIG. 2*a*.

In some embodiments, the shoe-supporting material can be polymer, polyethylene, polypropylene, plastic, Mylar, silk, cotton, nylon, Kevlar, polyester, or any other material, whether it is synthetic, natural, woven, or any other type of material. In some embodiments, the thickness of the material can be in the range between 2 mil and 30 mil, where 1 mil=1/1000 inches. Alternatively, the thickness can be in the range of 10 mil to 20 mil. In some embodiments, the thickness can be 15 mil.

The following is a description of some alternate embodiments of the collapsible snowshoe.

FIGS. 9*a*-9*j* illustrate various exemplary embodiments of a snowshoe, according to some embodiments of the present invention.

Figure 9A:
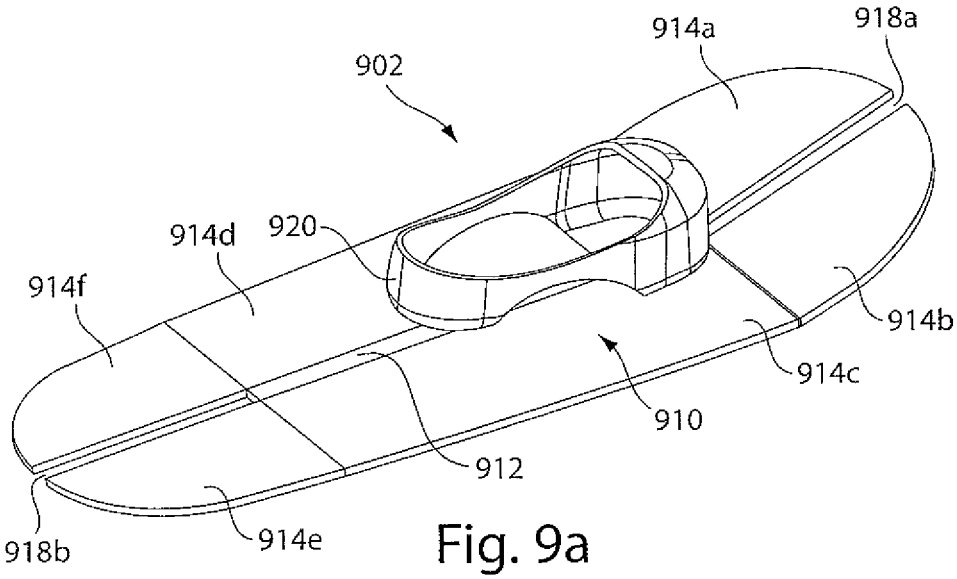
FIGS. 9*a*-9*j* illustrate various exemplary embodiments of a collapsible snowshoe, according to some embodiments of the present invention.
Figure 9B:
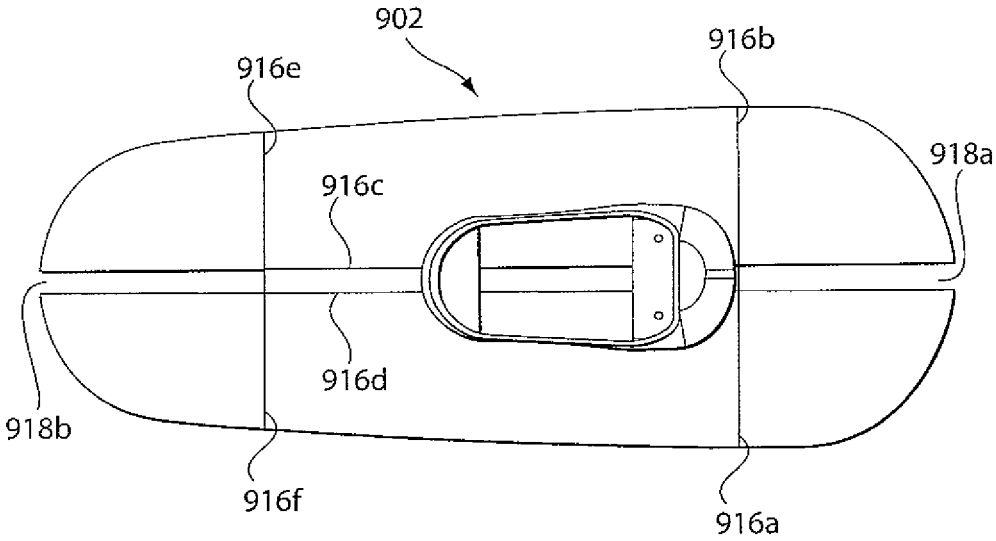
Figure 9C:
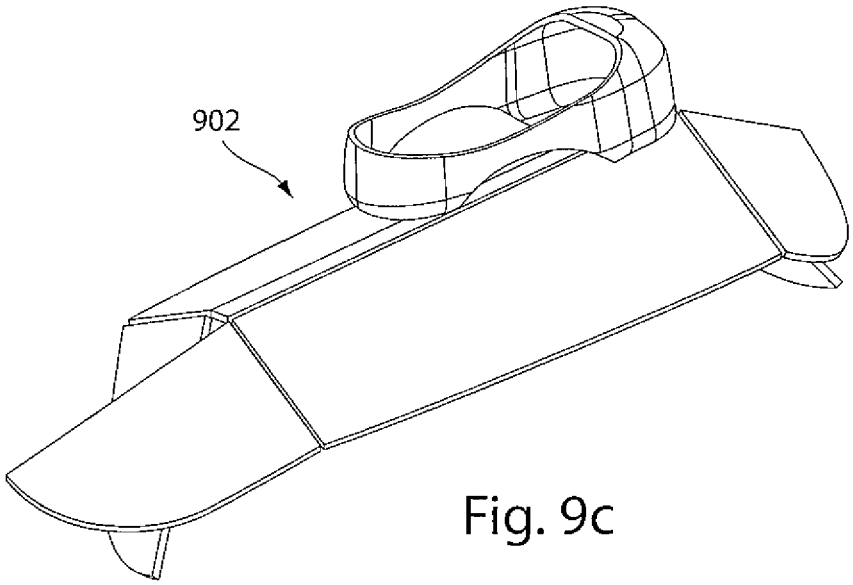
Figure 9D:
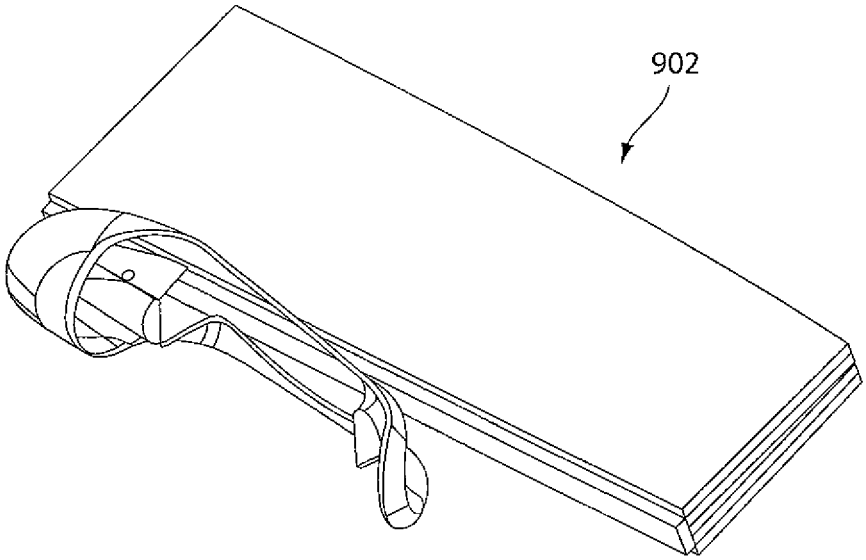
Figure 9E:
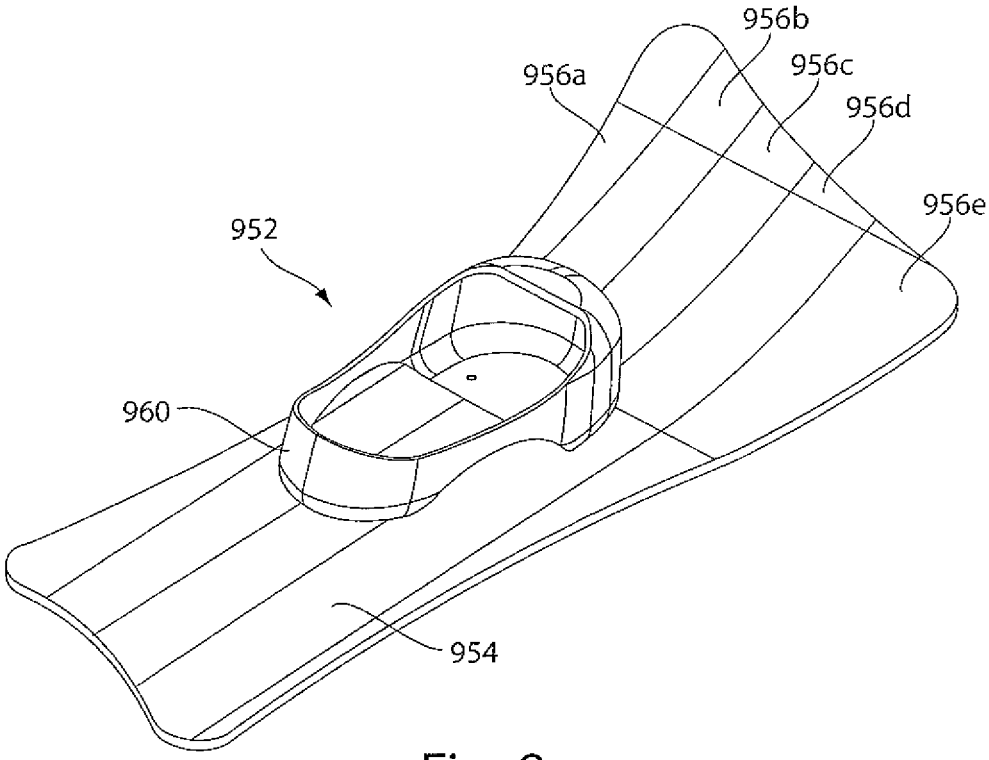
Figure 9F:
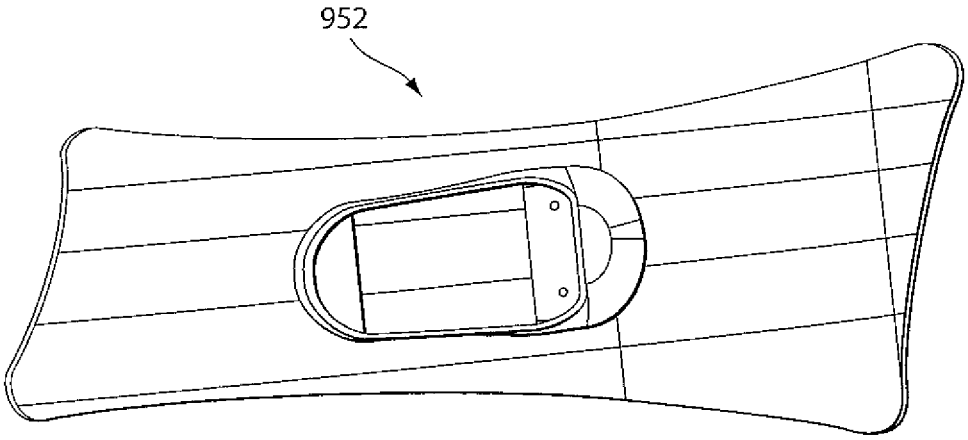

FIGS. 9*a*-9*d* illustrate various view of a snowshoe 902, according to some embodiments of the present invention. FIG. 9*a* is a top perspective view of the snowshoe 902. FIG. 9*b* is a top view of the snowshoe 902. FIG. 9*c* is a top perspective view of the snowshoe 902 in a process of being collapsed. FIG. 9*d* is a top perspective view of the snowshoe 902 in a collapsed state.

Snowshoe 902 includes a collapsible platform 910 to which includes a center connector 912 and collapsible portions 914 (*a, b, c, d, e, f*). Portions 914*a* and 914*b* are located in the front of the snowshoe 902. Portions 914*c* and 914*d* are located in the middle of the snowshoe 902. Portions 914*e* and 914*f* are located in the back of the snowshoe 902. The portions 914 are separated by the fold lines 916 (*a, b, c, d, e, f*) and spaces 918(*a, b*). In particular, the portions 914*a* and 914*b* are separated by a space 918*a*; the portions 914*a* and 914*d* are separated by a fold line 916*b*; the portions 914*b* and 914*c* are separated by a fold line 916*a*; the portions 914*d* and 914*f* are separated by a fold line 916*e*; the portions 914*c* and 914*e* are separated by a fold line 916*f*; the portions 914*f* and 914*e* are separated by the space 918*b*. The fold lines 916 can be configured to provide support to the user by allowing the portions to fold in a downward direction by not in the upward direction (as illustrated in FIGS. 9*c* and 9*d*). The fold lines 916*a*, 916*b*, 916*e* and 916*f* are configured to be parallel to each other. The fold lines 916*c* and the fold lines 916*d* are configured to be parallel to each other. The fold lines 916*a*, 916*b*, 916*e*, 916*f* are configured to be perpendicular to the fold lines 916*c* and 916*d*.

As shown in FIGS. 9*c* and 9*d*, the portions 914 fold around the connector 912 toward one another. Specifically, the portions 914*c* and 914*d* toward one another in a downward direction; the portions 914*f* and 914*d* fold toward one another; the portions 914*e* and 914*c* forward toward one another; and similarly with regard to other portions (see, FIGS. 9*c* and 9*d*). The thickness of the connector 912 can be configured to allow such folding.

In some embodiments, the snowshoe 902 can be configured to include a shoe holder 920 that is configured to be attached to the connector 912. Thus, when the snowshoe 920 is in an unfolded state, the shoe holder 920 is configured to sit on top of the platform 910. This way, the user can insert his/her foot into the shoe holder 910. The unfolded platform 910 provides adequate support to the user. In the folded state (FIG. 9*d*), the shoe holder 920 can be configured to wrap around the folded platform 910. The shoe holder 920 can be configured to be coupled to the connector 912 using VELCRO™, bolts, screws, glue, welding, or any other means. The shoe holder 920 can be configured to be removably or permanently coupled to the connector 912.

In some embodiments, the front portions 914*a* and 914*b* can be configured to allow upward tilting, as illustrated in FIG. 9*a*. Such tilting allows for improvement of the support for the user, floatation of the snowshoe, and tracking on the surface. The embodiment shown in FIGS. 9*a*-9*d* allows a user to provide for a compact snowshoe that can be easily folded into a small package.

Figure 9G:
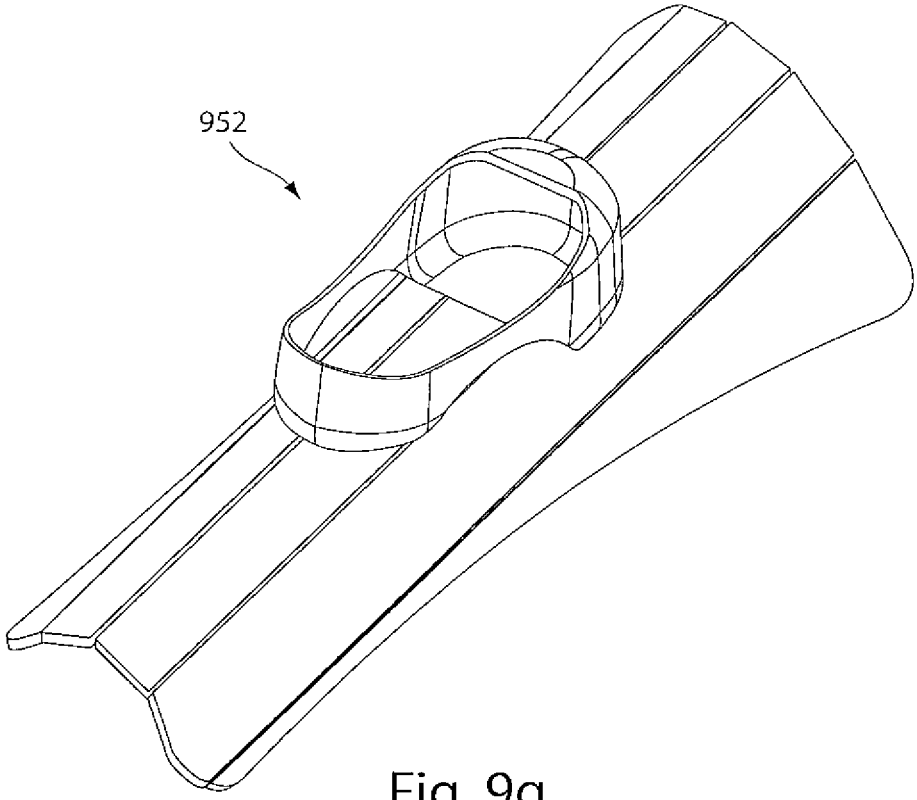
Figure 9H:
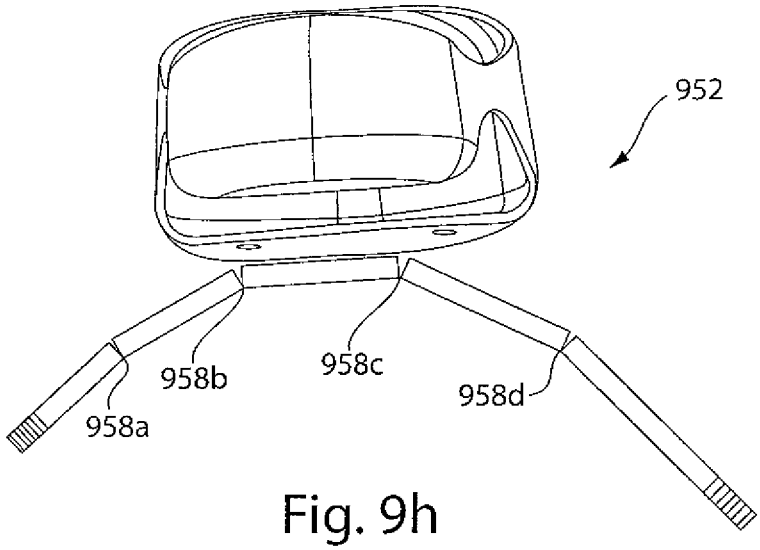
Figure 9I:
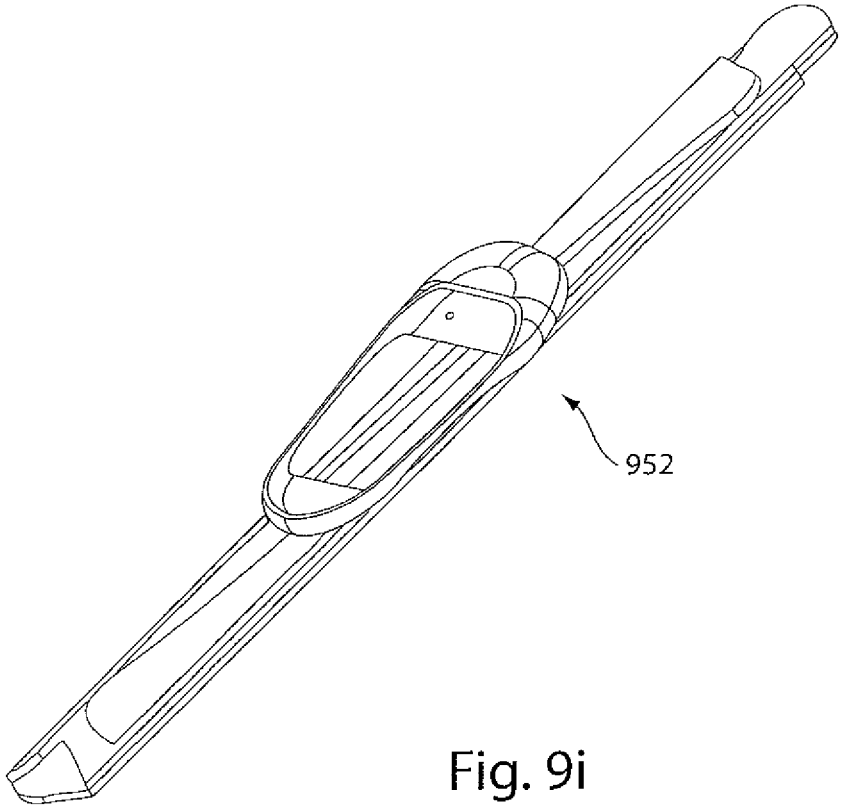
Figure 9J:
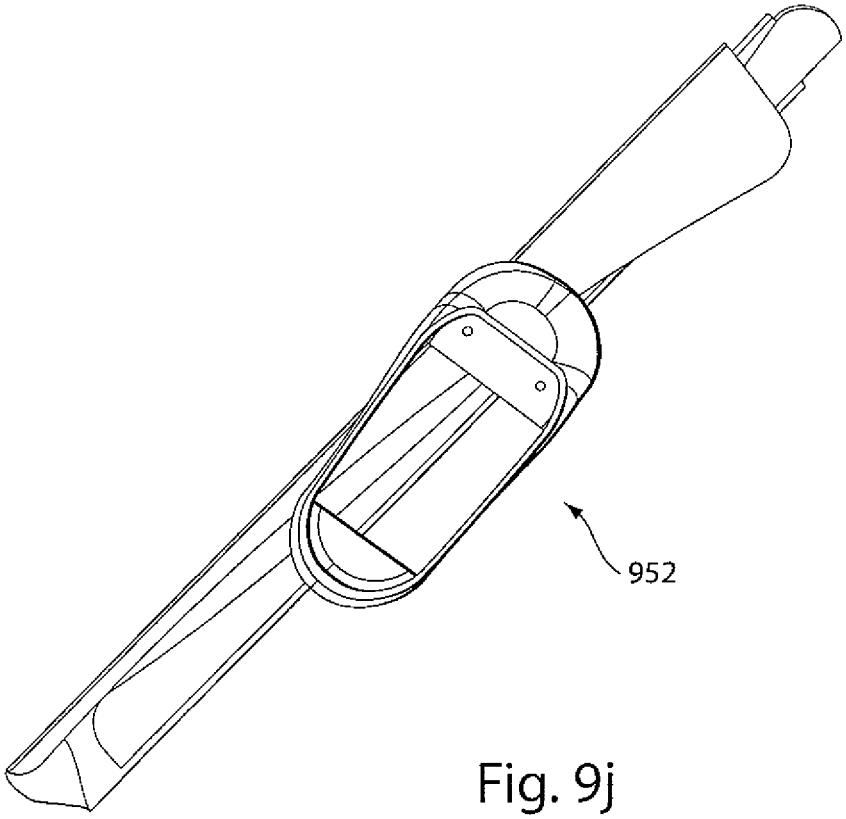

FIGS. 9*c*-9*j* illustrate another exemplary snowshoe 952, according to the some embodiments of the present invention. Similarly to the snowshoe 902, the snowshoe 952 includes a platform 954, a plurality of platforms 956 (*a, b, c, d, e*) coupled by a plurality of fold lines 958 (*a, b, c, d*). The fold lines 958 are configured to be parallel to each other. The fold lines 958 are configured to fold in a downward direction but not in an upward direction, as illustrated in FIGS. 9*g* and 9*h*. In a folded state, the platforms 956 are configured to fold one on top of another as illustrated in FIGS. 9*i* and 9*j*. The snowshoe 952 is configured to include a shoe holder 960 that is similar to the shoe holder 920 and can be configured to be attached to one of the platforms 956 (platform 956*c* as shown in FIG. 9*h*). As can be understood by one skilled in the art, there can be any arrangement of platforms and fold lines that allows folding a snowshoe in a compact state. As can be understood by one skilled in the art, at least one fold line in the snowshoe platforms can be parallel to at least one other fold line. Further, there can be any number of fold lines that are parallel to each other, for example, one fold line can be parallel to a second, a third, a fourth, etc. fold line. Further, the snowshoe can include fold lines that are not parallel to each other at all.

FIGS. 10*a*-10*i* illustrate another embodiment of a snowshoe 1000, according to some embodiments of the present invention. The snowshoe 1000 can be configured to be a collapsible snowshoe that uses structural members 1001 (*a, b, c, d, e*) that hold a fabric or membrane 1003 in a spread out configuration for snow flotation. When not needed, the members 1001 are configured to rotate or otherwise collapse to decrease the overall size of the snowshoe.

Figure 10A:
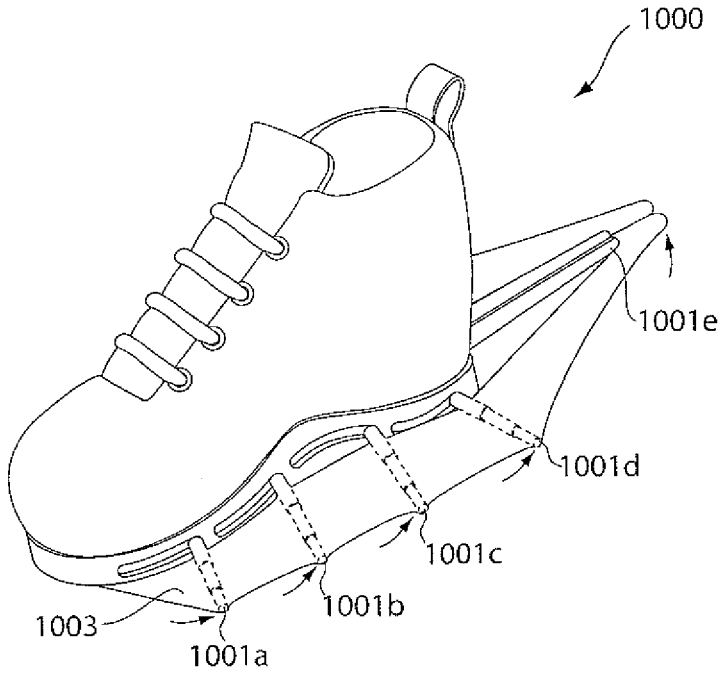
FIGS. 10*a*-10*i* illustrate yet another exemplary embodiment of a collapsible snowshoe, according to some embodiments of the present invention.
Figure 10B:
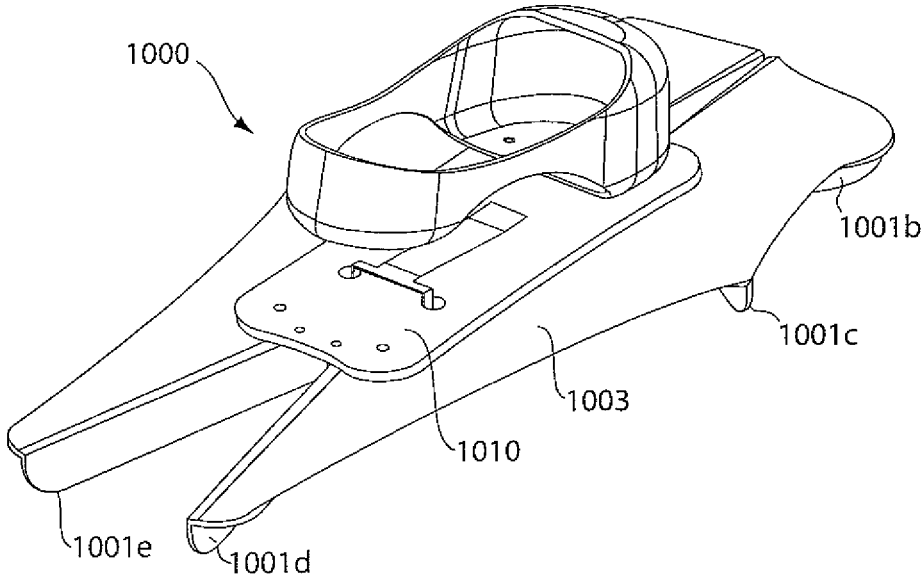
Figure 10C:
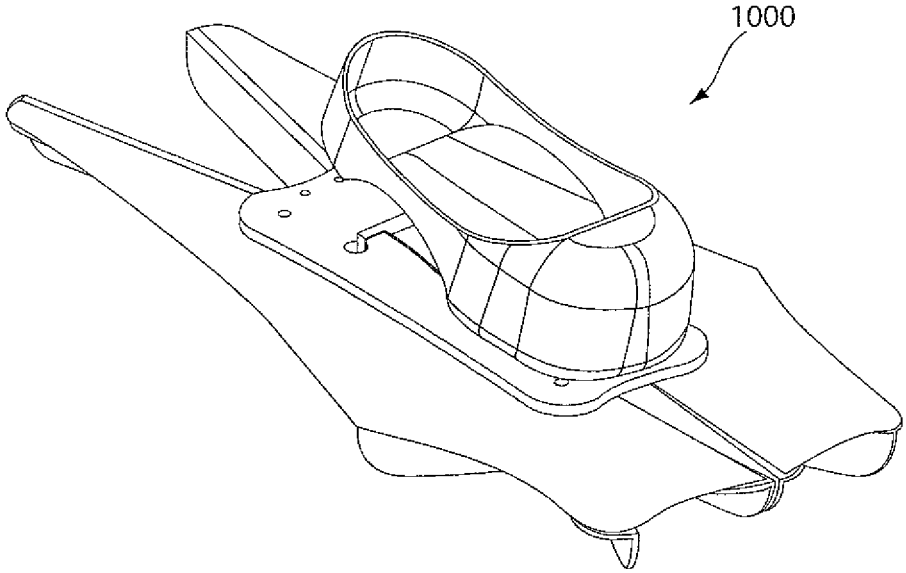
Figure 10D:
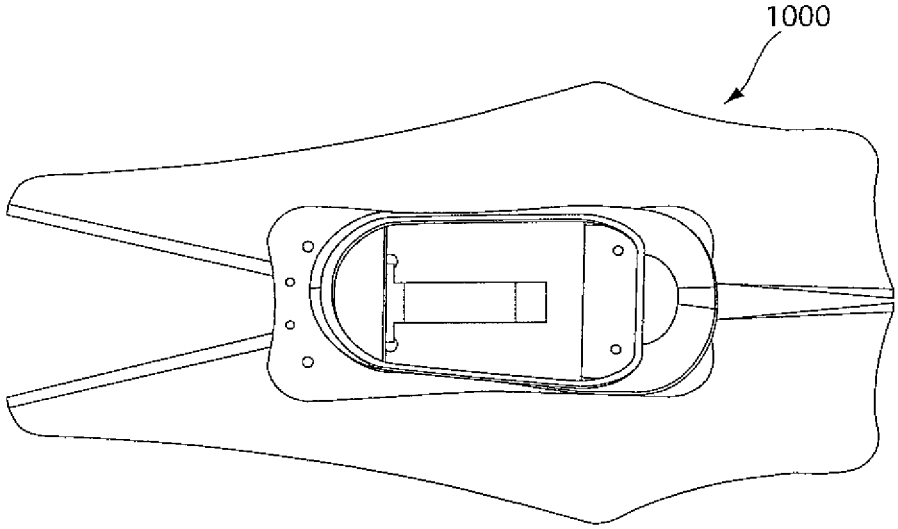
Figure 10E:
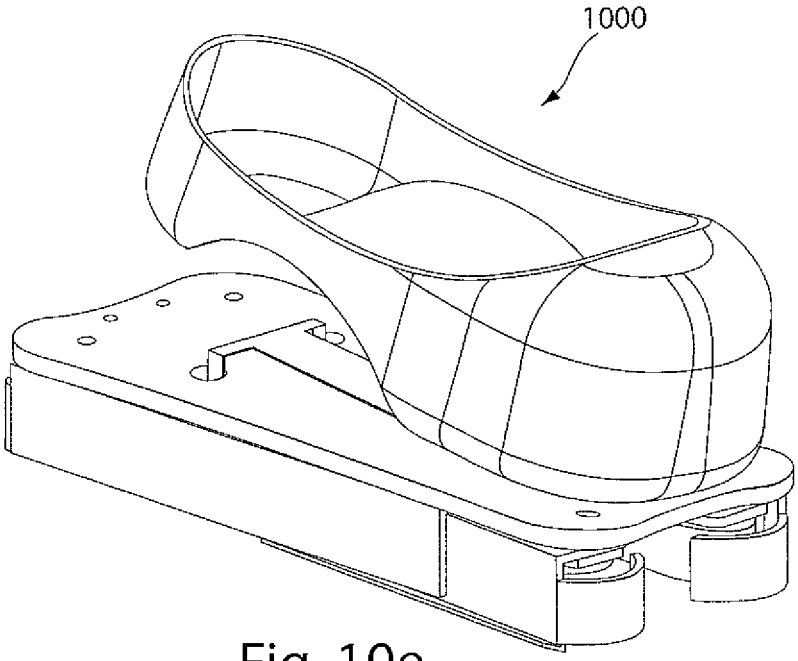
Figure 10F:
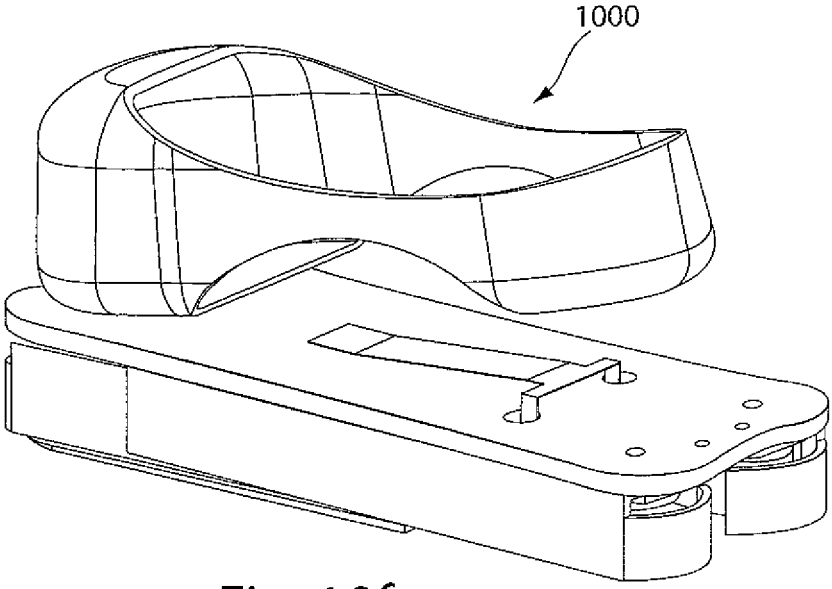
Figure 10G:
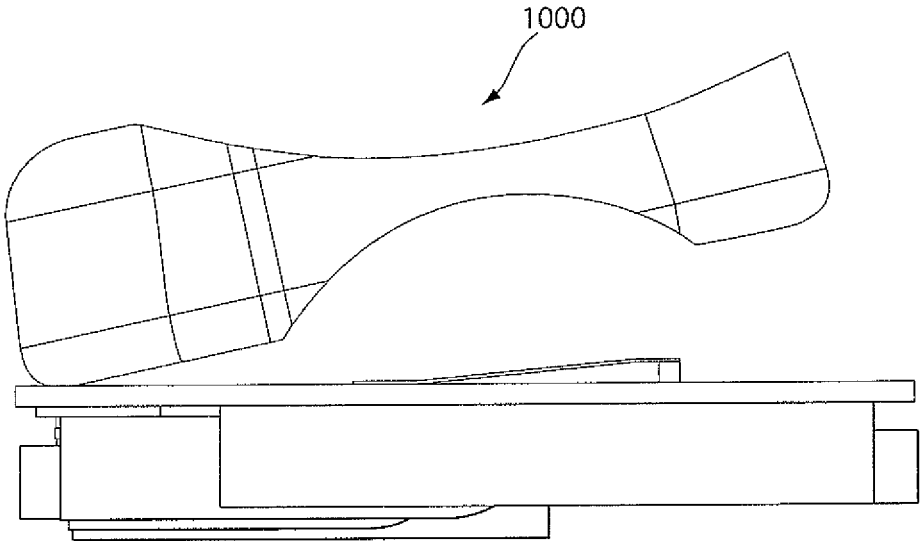

FIGS. 10*b*-10*d* are top views of the snowshoe 1000 having a plate 1010 and scaffolding or shoe-supporting material 1006. In some embodiments, the material 1006 can be split into a plurality of portions 1006*a* and 1006*b*, as illustrated in FIGS. 10*b*-10*d*. This allows folding of the material in two different directions. The material folds under the plate 1010, when the snowshoe 1000 is not in used. The folded configuration is illustrated in FIGS. 10*e*-10*g* and 10*i*.

Figure 10H:
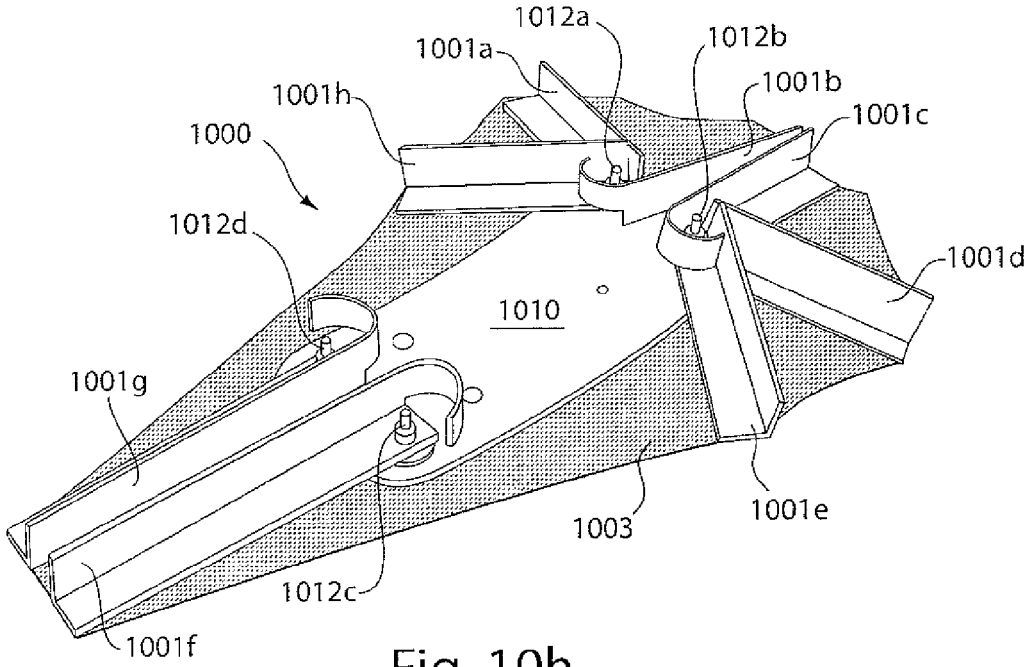
Figure 10I:
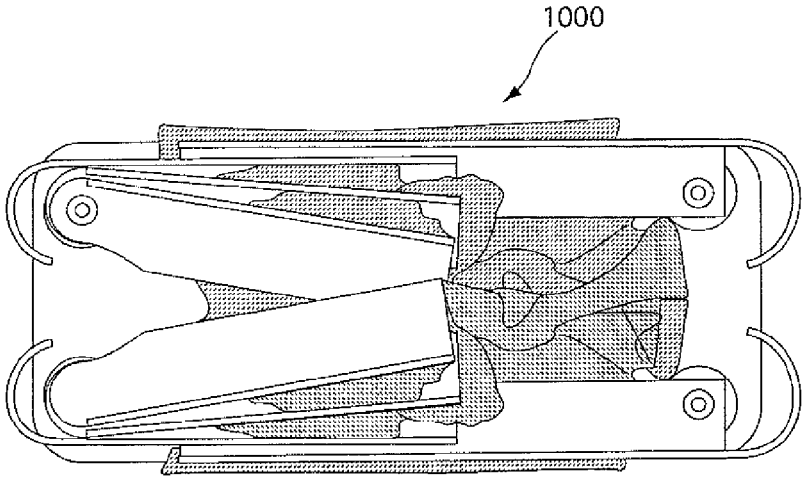

As illustrated in FIG. 10*h*, the material 1006 is configured to be secured to the structural members 1001. As illustrated, there are eight structural members 1001. Back structural members 1001*a* and 1001*b* are disposed at the back of the plate 1010 and are configured to rotate around respective pivotal connectors 1012*a* and 1012*b* in and out of the folded state (as illustrated in FIGS. 10*e*-10*g* and 10*i*). The front members 1001*e* and 1001*f* are configured to rotate around respective pivotal connectors 1012*c* and 1012*d*. The side members 1001*c*-*d* and 1001*g*-*h* are also configured to rotate around respective pivotal connectors 1012*c* and 1012*d* (i.e., members 1001*c*-*d* rotate around connector 1012*c* and members 1001*g*-*h* rotate around connector 1012*d*). The materials used for the members 1001, material 1006, and the plate 1010 can be similar to the materials discussed above. In some embodiments, the members 1001 can be configured to include locking mechanisms to prevent them from freely oscillating around the connectors 1012. Such locking mechanisms can be any conventional locking mechanisms.

In some embodiments, the present invention relates to a system for walking using any of the above collapsible snowshoes illustrated in FIGS. 1*a*-10*i*. The system can include a plurality of cross-bars configured to interact with each other, alternatively the cross-bars can be pivotally coupled to each other. The cross-bars can be configured to switch between an open position and a closed position. In the open position, cross-bars' outermost tips can be configured to rotate away from one another. In the closed position, the outermost tips can be configured to rotate toward each other. The system also includes a stretchable support material secured to at least portions of the cross-bars and configured to provide largest surface support area when the cross-bars are in the open position. The system also includes a locking mechanism (as shown in FIGS. 1*a*-1*g*) configured to secure the cross-bars in the open position.

In some embodiments, the present invention relates to a method for walking using the collapsible snowshoe shown in FIGS. 1*a*-10*i*. The method can include steps of rotating cross-bars from the closed position to the open position and securing the shoe-supporting material to the front portion of the cross-bars using the frame-locking mechanism. Additionally, a user's shoe can be inserted into the shoe holder that is secured to the snowshoe.

Further, in some embodiments, the present invention also relates to a method of manufacturing the snowshoe shown in FIGS. 1*a*-10*i*. The method can include steps of providing cross-bars, securing (whether pivotally or not) the cross-bars to each other, coupling at least a portion of the shoe-supporting material to the back portion of each of the cross-bars, coupling at least a portion of another shoe-supporting material to the front portion of each of the cross-bars, wherein another shoe-supporting material is configured to stretch between the front portion of the cross-bars when the cross-bars are in the open position, and securing frame-locking mechanism to at least another portion of the shoe-supporting material. Alternatively, a shoe holder can be also secured to the supporting material.

Further features and advantages of the invention, as well as structure and operation of various embodiments of the invention, are disclosed in detail below with references to the accompanying drawings.

Example embodiments of the methods and components of the present invention have been described herein. As noted elsewhere, these example embodiments have been described for illustrative purposes only, and are not limiting. Other embodiments are possible and are covered by the invention. Such embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

What is claimed is:

1. A method for walking using a snowshoe, having a supporting cross-bar configured to cross and to be pivotally coupled to another supporting cross-bar, wherein the cross-bars are configured to alternate between an open position and a closed position, wherein each said supporting cross-bar and said another supporting cross-bar includes a respective front portion and a respective back portion and said pivotal coupling of said supporting cross-bar and said another supporting cross-bar is configured to be located between respective front and back portions of said supporting cross-bars, a supporting material configured to be coupled to the cross-bars and further configured to extend between the cross-bars, whereby the extended supporting material creates a surface for walking when the cross-bars are in the open position, and a frame-locking mechanism configured to secure the cross-bars in the open position, the method comprising the steps of:

extending cross-bars from the closed position to the open position; and securing the supporting material to the front portion of the cross-bars using the frame-locking mechanism.

2. The method according to claim 1, wherein the snowshoe includes a shoe holder coupled to a top portion of the first supporting material, the method further comprising:

inserting a shoe into the shoe holder for walking.

3. The method according to claim 2, wherein the shoe holder is configured to secure a shoe to said frame.

4. The method according to claim 2, wherein each said cross-bar includes a front portion and a back portion, wherein said front portion is curved upwards.

5. The method according to claim 4, wherein said front portion is curved upwards at an angle of 10° to 90° relative to said back portion.

6. The method according to claim 4, wherein the snowshoe includes a pivot configured to pivotally couple said cross-bars;

wherein said cross-bars are configured to rotate about said pivot to a predetermined angle.

7. The method according to claim 4, wherein each said front and back portion is configured to independently rotate around said pivot.

8. The method according to claim 7, wherein a distance between outermost tips of said front portions of said cross-bars, located away from said pivot, is configured to be greater than a distance between outermost tips of said back portions of said cross-bars, located away from said pivot, when said cross-bars are in said open position.

9. The method according to claim 6, wherein said cross-bars are configured to telescopically expand away from said pivot.

10. The method according to claim 6, wherein said first supporting material is configured to be permanently coupled to said back portion of each said cross-bar and, using said frame-locking mechanism, to be detachably coupled to said front portion of each said cross-bar.

11. The method according to claim 10, wherein said first supporting material is configured to be detachably coupled to said front portion of each said cross-bar between said pivot and outermost tips of said front portion of each said cross-bar.

12. The method according to claim 6, wherein a diameter of said cross-bars is in a range of 8 mm to 40 mm;

a total surface area of said supporting materials is in a range of 75 square inches to 375 square inches.

13. The method according to claim 6, wherein said first supporting material further comprises two sides, wherein one side is configured to extend between said front portion of said cross-bar and said back portion of said another cross-bar and another side is configured to extend between said front portion of said second cross-bar and said back portion of said cross-bar;

a back side configured to extend between each said back portion of said first cross-bars, when said cross-bars are in said open position;

wherein each said side is configured to have varying degrees of concavity.

14. The method according to claim 6, wherein the snowshoe includes a second supporting material configured to restrain rotation of said cross-bars about said pivot;

wherein said first supporting material further includes a top portion and a bottom portion and said bottom portion of said first supporting material is configured to be adjacent to said pivot and said cross-bars.

15. The method according to claim 14, wherein at least a portion of said first supporting material is configured to be permanently coupled to said back portion of each said cross-bar; and said second supporting material is configured to be permanently coupled to said front portion of each said cross-bar.

16. The method according to claim 15, wherein said frame-locking mechanism is configured to be detachably coupled to said front portions of said cross-bars and thereby restrain rotation of said cross-bars from said open position to said closed position.

17. The method according to claim 16, wherein said cross-bars are configured to be substantially apart to each other in said open position and said cross-bars are configured to be substantially adjacent from each other in said closed position.

18. The method according to claim 2, wherein said frame-locking mechanism is configured to be secured to at least a portion of said first supporting material.

19. The method according to claim 2, wherein said cross-bars are manufactured from a material selected from a group consisting of: aluminum, titanium, stainless steel, fiberglass, fiber, wood, steel, magnesium, carbon-fiber, magnesium-lithium alloy, and plastic.

20. The method according to claim 2, wherein said supporting materials are selected from a group consisting of: micro-fiber, nylon, acron, and Kevlar, polyester, polymer, polyethylene, polypropylene, Mylar, silk, and cotton.

* * * * *